United States Patent [19]

Guerin

[11] Patent Number: 4,833,848

[45] Date of Patent: May 30, 1989

[54] DOUBLE PANEL ASSEMBLY

[76] Inventor: Georges Guerin, L'Esclavissat, Estillac (Lot-et-Garonne), France

[21] Appl. No.: 55,469

[22] Filed: May 28, 1987

[30] Foreign Application Priority Data

May 28, 1986 [FR] France ..... 86 07996

[51] Int. Cl.[4] ..... E04B 2/72

[52] U.S. Cl. ..... 52/242; 52/238.1; 52/823; 403/295

[58] Field of Search ..... 52/238.1, 285, 823, 52/242; 403/295

[56] References Cited

U.S. PATENT DOCUMENTS

| | | | |
|---|---|---|---|
| 2,097,484 | 11/1937 | Winslow | 52/823 |
| 2,965,935 | 12/1960 | Olsen | 403/295 |
| 3,269,455 | 8/1966 | Gillotti | 403/295 |
| 3,709,533 | 1/1973 | Walters | 403/295 |
| 3,871,153 | 3/1975 | Birum, Jr. | 52/823 |
| 3,998,027 | 12/1976 | Wendt | 52/242 |
| 4,040,755 | 8/1977 | Jorgensen et al. | 403/295 |
| 4,099,815 | 7/1978 | Cox et al. | 403/295 |
| 4,196,556 | 4/1980 | Russo | 52/285 |
| 4,625,476 | 12/1986 | Shimada | 52/238.1 |
| 4,683,634 | 8/1987 | Cole | 403/295 |

*Primary Examiner*—David A. Scherbel
*Assistant Examiner*—Caroline D. Dennison
*Attorney, Agent, or Firm*—Herbert Dubno; Andrew Wilford

[57] ABSTRACT

A panel assembly has a pair of substantially congruent and polygonal flat panels each having a plurality of straight edges meeting at corners and respective W-section rails extending along the edges and having ends at the corners. Each rail is formed with a pair of parallel, spaced, and inwardly open rail grooves receiving the respective edges and holding the panels parallel to and spaced from each other, and with a central outwardly open hardware groove flanked by the rail grooves and opening oppositely thereto. Respective corner pieces at the corners each have a pair of projections fitting longitudinally into the ends of the central grooves of the respective rails and each such piece is formed with at least one outwardly open threaded bore adapted to receive a threaded stem. Normally according to this invention the panels are rectangular and vertical with lower corners and upper corners. The bores of the pieces of the upper corners open upward and the bores of the pieces of the lower corners open downward. Such an assembly can have guide assemblies having bolts threaded into the bores of the lower corners and even hangers having bolts threaded into the bores of the upper corners. Furthermore the bores can be fitted with bolts forming pivots for use of the panel assembly as a pivotal door, as a tablet foldable against the wall, and/or as part of an accordian-type multiple-folding partition.

11 Claims, 2 Drawing Sheets

DOUBLE PANEL ASSEMBLY

FIELD OF THE INVENTION

The present invention relates to a double panel assembly. More particularly this invention concerns a structural element basically formed of two similar panels held parallel to but spaced from one another by a frame extending around the panel edges.

BACKGROUND OF THE INVENTION

A standard structural element for interior or exterior use comprises two like polygonal panels, normally of rectangular shape, that are mounted in a frame that holds them parallel to each other but at a modest spacing. The panels can be of glass for a Thermopane TM effect, in which case the space between them is filled with gas to act as insulation These panels can also be of dissimilar materials and thicknesses, although they are always of the same shape, and the space between them could be filled with any desired material depending on whether sound-deadening, insulating, conducting, or other effects were desired.

The standard frame for such an assembly is formed by a plurality of rails that are mitered at the corners to form a corner joint. Such rails can be made of extruded or otherwise profiled metal or plastic and invariably have two parallel but spaced grooves into which the respective side edges of the panels engage.

Accurately cutting and fitting these rails together is difficult, as is assembling them with the panels. Typically a glue or caulk is employed to secure the assembly together, entailing a messy step in the fabrication of such a panel assembly and making subsequent disassembly virtually impossible. Another disadvantage is that the frame thus formed is not particularly strong, so that mounting such a panel assembly for use as a sliding or pivoting door becomes fairly difficult, entailing the fastening of special hardware to the panels and rails at the corners.

OBJECTS OF THE INVENTION

It is therefore an object of the present invention to provide an improved dual-panel assembly.

Another object is the provision of such a dual-panel assembly which overcomes the above-given disadvantages, that is which is relatively easy to assemble and use while forming a very solid assembly to which hinges, hangers, or the like can be fastened with ease.

SUMMARY OF THE INVENTION

A panel assembly according to the invention has a pair of substantially congruent and polygonal flat panels each having a plurality of straight edges meeting at corners and respective W-section rails extending along the edges and having ends at the corners. Each rail is formed with a pair of parallel, spaced, and inwardly open rail grooves receiving the respective edges and holding the panels parallel to and spaced from each other, and with a central outwardly open hardware groove flanked by the rail grooves and opening oppositely thereto. Respective corner pieces at the corners each have a pair of projections fitting longitudinally into the ends of the central grooves of the respective rails and each such piece is formed with at least one outwardly open threaded bore adapted to receive a threaded stem. Normally according to this invention the panels are rectangular and vertical with lower corners and upper corners. The bores of the pieces of the upper corners open upward and the bores of the pieces of the lower corners open downward. Such an assembly can have guide assemblies having bolts threaded into the bores of the lower corners and even hangers having bolts threaded into the bores of the upper corners. Furthermore the bores can be fitted with bolts forming pivots for use of the panel assembly as a pivotal door, as a tablet foldable against the wall, and/or as part of an accordion-type multiple-folding partition.

The principal advantage of this arrangement is that the corner pieces actually engage into both of the rails and secure them together against relative movement. Thus they can serve as solid anchors for various types of hardware, allowing the panels to be used directly in all different types of construction. What is more the assemblies can be disassembled if desired and the parts reused, even recut and reused if desired.

The system of this invention also includes a clip engageable laterally into a central groove of a first such panel assembly and simultaneously longitudinally over a corner piece of a second such panel assembly extending perpendicularly from the first assembly, and means for securing the clip to the corner piece of the second panel assembly and thereby fixing the first and second panels together with the second assembly projecting perpendicularly from the first assembly. This means can be a simple bolt engaged in the bore of the clip of the second assembly. The panels of this invention can therefore be used for partitioning off space in a very flexible manner, and can be shifted about if necessary by loosening the clips, if desired.

According to another feature of this invention the projections are arms fitting generally complementarily into the respective central grooves. The central grooves are undercut such that the arms can only be inserted longitudinally of the respective rails therein or removed longitudinally therefrom. In addition each central groove is formed with an aperture adjacent the respective rail end, each arm being formed with a tooth engaging laterally through the respective aperture. The teeth are of sawtooth shape and the corner pieces are formed around the projections with recesses into which the respective rail ends engage.

DESCRIPTION OF THE DRAWING

The above and other features and advantages will become more readily apparent from the following, reference being made to the accompanying drawing in which.

SPECIFIC DESCRIPTION

Figure 1:
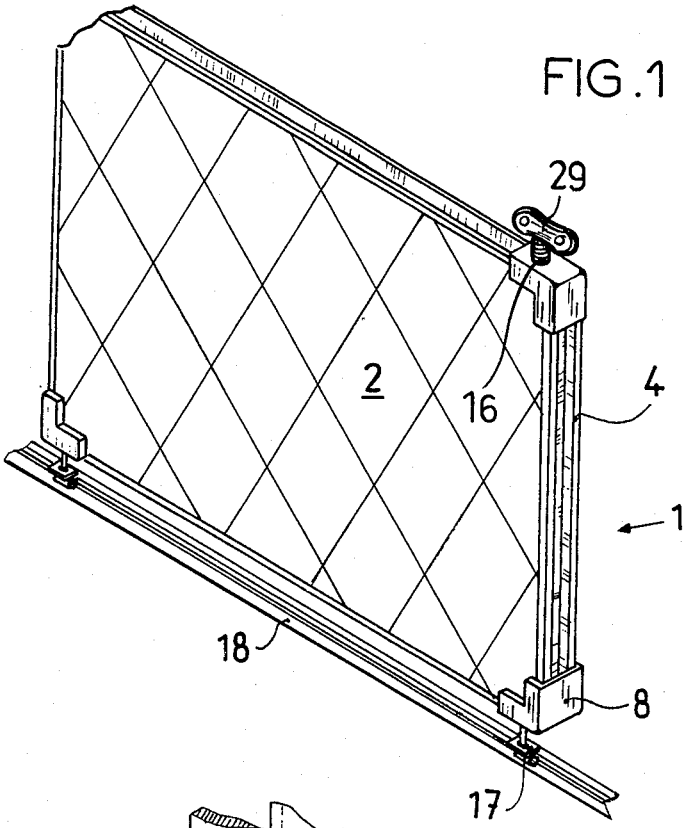
FIG. 1 is a small-scale perspective view of a panel assembly according to the invention, here used as a sliding partition.
Figure 2:
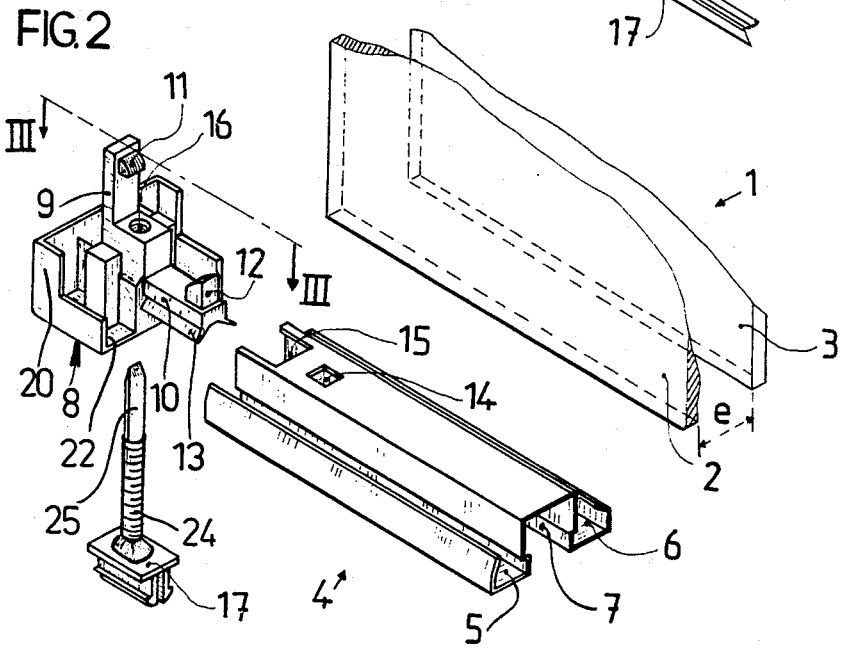
FIG. 2 is a large-scale exploded view of the corner of the assembly.
Figure 3:
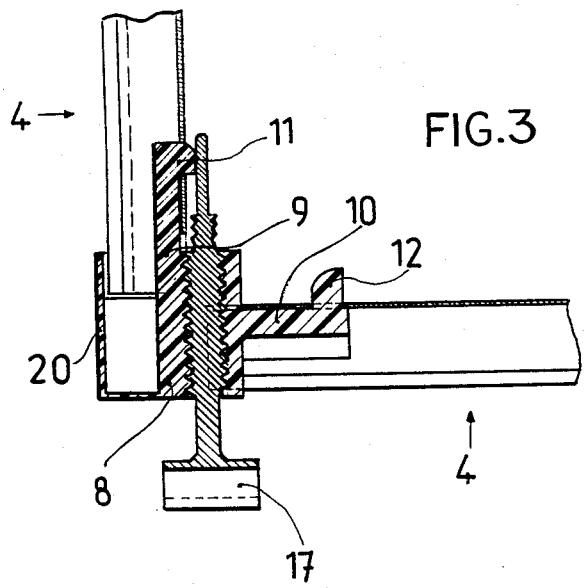
FIG. 3 is a section taken along line III—III of FIG. 2 but showing the corner fully assembled.

As seen in FIG. 1 the panel assembly 1 according to this invention comprises a pair of rigid and identically rectangular panels 2 and 3 that are parallel to each other and separated by a space e and a frame constituted by four W-section square-ended rails 4 and four corner pieces 8. The rails 4 may be of different length but are otherwise identical, that is of identical section, and the corner pieces 8 are in fact all identical.

Each rail 4 is formed as a profiled strip of sheet metal with a pair of inwardly open panel grooves 5 and 6 flanking an outwardly open hardware groove 7. The central groove 7 is somewhat bigger than the flanking grooves 5 and 6 and is undercut, that is wider at the floor of the groove 7 than at its open outer end. This widening of the bottom of the groove 7 cooperates with bent-in outer lips of the rail 4 to make the grooves 5 and 6 similarly wider at the inwardly directed base than at their inner open ends. Each squared-off end of each rail 4 is formed in the floor of the respective groove 7 with a longitudinally outwardly open square notch 15 and somewhat inward therefrom with a smaller square aperture 14.

Each corner piece 8 has a pair of rectangular-section and mutually perpendicular arms 9 and 10 formed with respective inwardly directed sawtooth-shaped teeth 11 and 12. The arm 9 is shaped to fit snugly in the center groove 7 inward of the undercut thereof and the corner piece 8 is formed around this arm 9 with a skirt 20 shaped to fit snugly around the end of the rail 4 into which the arm 9 is fitted. The arm 10 is similarly shaped to fit within the central groove 7 of the adjacent rail 4 and has flexible lips or skirts 13 that press this arm 10 against the floor of the respective groove 7 and the piece 8 has recesses 22 flanking the arm 10 and receiving the end of the respective rail 4. When the arms 9 and 10 are fully inserted into the respective grooves 7 the respective teeth 11 and 12 engage into the respective holes 14. In fact the entire corner assembly is snap-fitted together without the use of special tools.

The rails 4 can be provided in a series of different lengths for panel assemblies of different size. For custom setups they can be cut to length and the notch 15 and aperture 14 can be simply formed by a special-duty punch.

In addition each corner piece 8 is formed with a threaded bore 16 extending parallel to but inwardly offset from the respective arm 9. The location of this bore 16 is such that it is in excellent force-transmitting engagement with the rails 4 associated with the respective corner piece 8.

In the illustrated embodiment a guide bolt 24 having a pilot pin 25 is threaded into the bores 16 of the lower corners and has a head formed as a slider 17 engageable in a floor-mounted rail 18. The holes 16 of the top corners can be then provided with hangers 29 suspending the panels 1 from ceiling-mounted rails. Of course these holes 16 could be used simply for bolting the panels in place or to one another. Similarly they could be used as shown in FIG. 4 to secure gudgeons 30 for action as pivots so that the panels could be used as doors pivotal about vertical or horizontal axes on fixed objects or even on one another.

Figure 4:
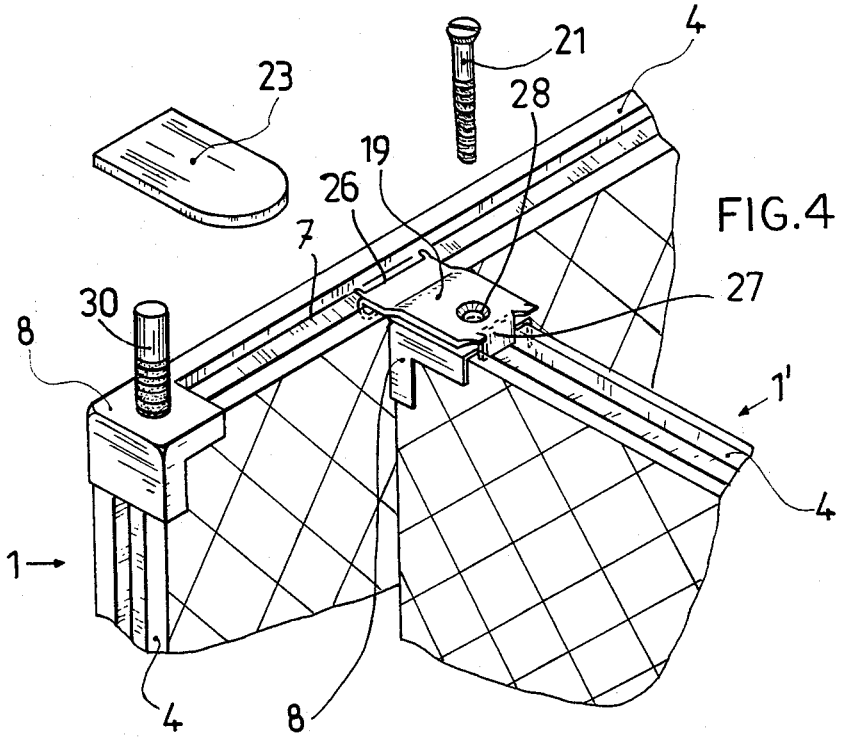
FIG. 4 is a partly exploded perspective view of a cross-panel assembly joint according to this invention.

FIG. 4 shows two such panels 1 and 1', the latter extending perpendicular from the former offset from the corners thereof. They are joined together by a clip 19 having a rear end 26 hooked transversely over the side of the one panel 1 into the groove thereof and a front end 28 hooked longitudinally over the corner piece 8 of the other panel 1'. This clip 19 is made of metal and formed with a hole 28 that aligns with the bore 16 of the corner piece 8 of the panel 1' so that a screw 21 can secure the clip 19 in place. The clip 19 tightly engages over the side of the groove 7 of the panel 1 to prevent the panel 1' from slipping longitudinally along the panel 1.

I claim:

1. A panel assembly comprising:

a pair of substantially congruent and rectangular flat panels each having a plurality of straight edges meeting at corners;

respective W-section rails extending along the edges and having squared ends at the corners, each rail forming a pair of parallel, spaced, and inwardly open rail grooves receiving the respective edges and holding the panels parallel to and spaced from each other, and a central outwardly open hardware groove flanked by the rail grooves and opening oppositely thereto; and respective corner pieces at the corners each having a pair of projections fitting longitudinally into the ends of the central grooves of the respective rails of the same panel assembly and securing same together against relative movement, each corner piece being formed with at least one outwardly open threaded bore adapted to receive a threaded stem.

2. The panel assembly defined in claim 1 wherein the panels are vertical with lower corners and upper corners, bores of the pieces of the upper corners opening upward and the bores of the pieces of the lower corners opening downward, the assembly further comprising:

guide assemblies having bolts engaged in the bores of the lower corners.

3. The panel assembly defined in claim 1 wherein the panels are vertical with lower corners and upper corners, bores of the pieces of the upper corners opening upward and the bores of the pieces of the lower corners opening downward, the assembly further comprising:

guide assemblies having bolts threaded into the bores of the lower corners and hangers having bolts threaded into the bores of the upper corners.

4. The panel assembly defined in claim 1, further comprising:

a clip engageable laterally into a central groove of a first such panel assembly and simultaneously longitudinally over a corner piece of a second such panel assembly extending perpendicularly from the first assembly; and means for securing the clip to the corner piece of the second panel assembly and thereby fixing the first and second panels together with the second assembly projecting perpendicularly from the first assembly.

5. The panel assembly defined in claim 1, further comprising bolts forming pivots received in at least some of the bores.

6. The panel assembly defined in claim 1 wherein the projections are arms fitting generally complementarily into the respective central grooves.

7. The panel assembly defined in claim 6 wherein the central grooves are undercut such that the arms can only be inserted longitudinally of the respective rails therein or removed longitudinally therefrom.

8. The panel assembly defined in claim 6 wherein each central groove is formed with an aperture adjacent the respective rail end, each arm being formed with a tooth engaging laterally through the respective aperture.

9. The panel assembly defined in claim 8 wherein the teeth are of sawtooth shape.

10. The panel assembly defined in claim 1 wherein the corner pieces are formed adjacent the projections with recesses into which the respective rail ends engage.

11. The panel assembly defined in claim 1, further comprising means including formations on the projections and rails for releasably securing same together against relative movement.

* * * * *